US010349761B2

(12) United States Patent
Binali et al.

(10) Patent No.: US 10,349,761 B2
(45) Date of Patent: Jul. 16, 2019

(54) FITTED SHEET CONSTRUCTS AND METHODS OF MAKING THE SAME

(71) Applicant: Medline Industries, Inc, Northfield, IL (US)

(72) Inventors: Syed Binali, Northbrook, IL (US); Kelly Martinucci, Mundelein, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 15/905,439

(22) Filed: Feb. 26, 2018

(65) Prior Publication Data

US 2018/0242763 A1 Aug. 30, 2018

Related U.S. Application Data

(60) Provisional application No. 62/464,633, filed on Feb. 28, 2017.

(51) Int. Cl.
*A47G 9/02* (2006.01)
*D05B 23/00* (2006.01)

(52) U.S. Cl.
CPC ..... *A47G 9/0246* (2013.01); *D05B 23/00* (2013.01); *D05D 2305/02* (2013.01); *D10B 2503/062* (2013.01)

(58) Field of Classification Search
CPC ..... A47G 9/0246; A47D 15/02
See application file for complete search history.

(56) References Cited

U.S. PATENT DOCUMENTS

| | | | | |
|---|---|---|---|---|
| 3,380,086 | A * | 4/1968 | McCurry | A47G 9/0246 281/34 |
| 4,777,894 | A * | 10/1988 | Joyce | A47G 9/0246 112/475.06 |
| 5,249,322 | A * | 10/1993 | Seago | A47G 9/0246 112/163 |
| 5,325,555 | A | 7/1994 | Whitley | |
| 5,515,799 | A * | 5/1996 | Heptner | A47G 9/0246 112/475.08 |
| 5,765,241 | A * | 6/1998 | Macdonald | A47G 9/0246 112/475.08 |
| 7,143,457 | B2 | 12/2006 | Macdonald | |
| 7,698,757 | B2 | 4/2010 | Macdonald | |
| 2012/0260424 | A1* | 10/2012 | Agarwall | A47G 9/0246 5/497 |

* cited by examiner

*Primary Examiner* — Tajash D Patel
(74) *Attorney, Agent, or Firm* — Philip H. Burrus, IV

(57) ABSTRACT

A fitted sheet (800) includes a first side margin (106) and the second side margin (107) folded about a first fold line (104) and a second fold line (105), respectively, toward a central panel (108) such that sides of the first side margin and the second side margin are separated by a separation (208). A first edge (209) and a second edge (211) occur where the first side margin and the central panel abut, while a third edge (210) and a fourth edge (212) occur where the second side margin and the central panel abut. The first edge includes a first seam (405), while the second edge includes a second seam (406). The third edge includes a third seam (407), while the fourth edge includes a fourth seam (408). Each seam is applied by a different sewing operation. At least two seams are different in color.

20 Claims, 8 Drawing Sheets

FITTED SHEET CONSTRUCTS AND METHODS OF MAKING THE SAME

CROSS REFERENCE TO PRIOR APPLICATIONS

This application claims priority and benefit under 35 U.S.C. § 119(e) from U.S. Provisional Application No. 62/464,633, filed Feb. 28, 2017, which is incorporated by reference for all purposes.

BACKGROUND

Technical Field

This disclosure relates generally to textiles, and more particularly to bedding textiles.

Background Art

Bedding textiles, including sheets, blankets, bedspreads, duvets, and the like are frequently applied to mattresses, futons, and other bedding to increase comfort. Sheets may be applied to protect the mattress from becoming soiled. A person can easily clean a sleeping surface by removing the sheets, washing them, and reapplying them to the mattress.

Traditional bedding sheets frequently consist of a fitted sheet and a top sheet. The top sheet is of a relatively simple construction. The top sheet is generally a flat layer of textile material that may have hemmed edges to prevent raveling. Occasionally an ornamental cuff is sewn along the top of a flat sheet to give it a more aesthetically pleasing appearance.

Fitted sheets are more complex. Fitted sheets are constructed with shapes approximating the size of the mattress to which they will be applied. An opening may have an elastic gathering to retain the fitted sheet to the mattress. Prior art fitted sheets require complex manufacturing steps, including cutting blanks into complex shapes, folding edges, sewing along non-linear seams, and so forth. It would be advantageous to have an improved fitted sheet and method of constructing the same.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
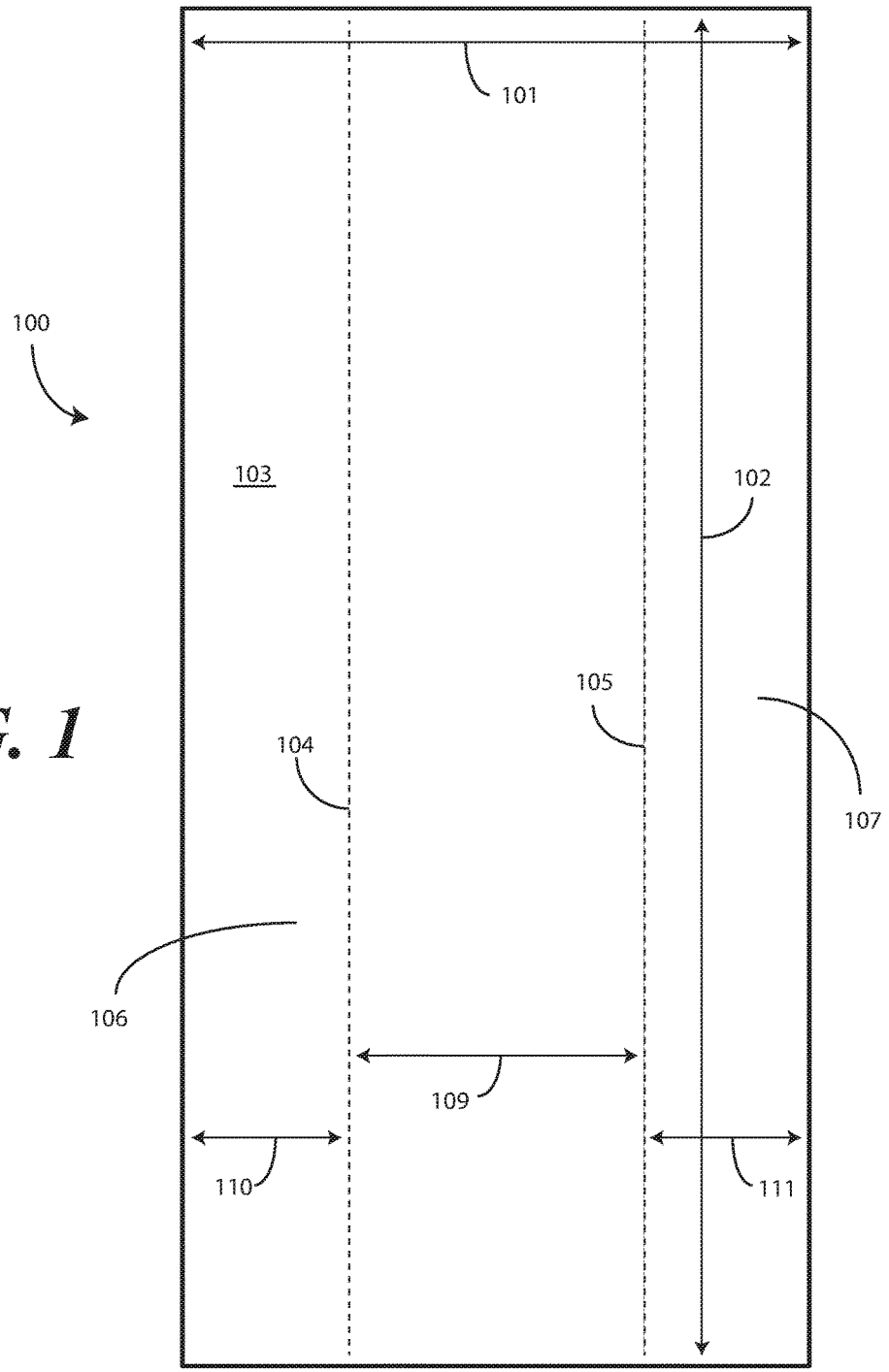
FIG. 1 illustrates an explanatory blank from which one or more fitted sheets in accordance with one or more embodiments of the disclosure can be constructed.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a fitted sheet, and method of making the same, that includes creating four seams along a folded blank prior to finishing a perimeter aperture with one or both of a finishing stitch and/or a border wrapper. In one or more embodiments, each seam of the fours seams is created by a different—and separate—sewing operation. For example, a first sewing operation can apply a first seam to a first edge where a first end of a first side margin of the folded blank and a central panel of the folded blank abut. A second sewing operation, different from the first sewing operation, then applies a second seam, separate from the first seam, to a second edge of the first side margin where a second end of the first side margin and the central panel abut.

A third sewing operation, different from either the first sewing operation or the second sewing operation, then applies a third seam along a third edge where a first end of the second side margin and the central panel abut. Similarly, a fourth sewing operation, different from any of the first sewing operation, the second sewing operation, or the third sewing operation, can apply a fourth seam along a fourth edge where a second end of the second side margin and the central panel abut.

In one or more embodiments, at least one seam of the first seam, the second seam, the third seam, or the fourth seam has a color that is different than at least another of the first seam, the second seam, the third seam, or the fourth seam. For example, the first seam and the third seam might be white, while the second seam and the fourth seam are blue. Similarly, the first seam and the fourth seam might be green, while the second seam and the third seam are white. In other embodiments, each of the first seam, the second seam, the third seam, and the fourth seam are different colors. This results in four colors for four seams.

In one or more embodiments, a fitted sheet comprises a blank defining a central panel, a first side margin, and a second side margin. In one or more embodiments, the first side margin and the second side margin are folded about a first fold line and a second fold line, respectively, toward the central panel along their lengths such sides of the first side margin and the second side margin are separated by a separation. This results in a folded blank having a first edge and a second edge where the first side margin and the central panel abut, and a third edge and a fourth edge where the second side margin and the central panel abut.

In one embodiment, the first edge comprises a first seam applied by a first sewing operation. Meanwhile, the second edge comprises a second seam, separate from the first seam, and applied by a second sewing operation separate from the first sewing operation. In one or more embodiments, the third edge comprises a third seam, separate from either the first seam or the second seam, and applied by a third sewing operation separate from either the first sewing operation or the second sewing operation. In one embodiment, the fourth edge comprises a fourth seam, separate from any of the first seam, the second seam, or the third seam, and applied by a fourth sewing operation separate from any of the first sewing operation, the second sewing operation, or the third sewing operation.

In one embodiment, one of the first seam, the second seam, the third seam, or the fourth seam, is a different color than another of the first seam, the second seam, the third seam, or the fourth seam. In one embodiment, a first of the first seam, the second seam, the third seam, or the fourth seam has a common color with a second of the first seam, the second seam, the third seam, or the fourth seam.

Illustrating by example, in one embodiment the first seam and the third seam have the common color, while the second seam and the fourth seam have the different color. However, in another embodiment the first seam and the fourth seam have the common color, while the second seam and the fourth seam have the different color. In still another embodiment, the first seam, the second seam, the third seam, and the fourth seam each have different colors. Other color combinations will be obvious to those of ordinary skill in the art having the benefit of this disclosure.

Turning now to FIG. 1, illustrated therein is one example of a blank 100 that is suitable for manufacturing one or more fitted sheets in accordance with embodiments of the disclosure. The blank 100 can be manufactured from a textile material 113 that is woven or knit. The textile material can further be manufactured with natural stretch capabilities. Said differently, it can be "stretchy" with the inclusion of elastic materials in the weave so as to stretch about a mattress when applied. In other embodiments, the textile material 113 can be a standard weave without stretch capabilities.

In one or more embodiments, the textile material 113 is woven. For example, the textile material may include a one-ply weave, a two-ply weave, and so forth. The weave can include warps and wefts. The warps are elements of the weave that run vertically in the view of FIG. 1, while the wefts run horizontally. Note that while the terms "warps" and "wefts" are used illustratively to describe the weave, those of ordinary skill in the art having the benefit of this disclosure will note that alternate terms, such as "warp threads," or "warp yarns" can be substituted for "warps." Similarly, "weft fill" or "weft threads" can be substituted for "wefts."

In one embodiment, the weave of the textile material 113 is a taffeta weave. A "taffeta" weave is a style of weave where the threads forming the wefts and warps intertwine alternatively to produce the checkerboard effect. The warps and wefts can include synthetic threads, organic threads, or combinations thereof. Illustrating by example, in one embodiment the warps and wefts comprise polyester. In another embodiment, the warps and wefts comprise cotton. In another embodiment, the warps and wefts comprise wool. Of course, combinations could be used as well. For instance, in another embodiment the warps and wefts can comprise a combination of cotton and polyester. Elastomeric materials may be interlaced with the weave to give the item a "stretchy" characteristic. Other examples of materials for the warps and wefts will be obvious to those of ordinary skill in the art having the benefit of this disclosure.

As shown in FIG. 1, the blank 100 is substantially rectangular in shape and is defined by a length 102 and a width 103. In one embodiment, the length is about eighty-four inches, while the width is about forty-eight inches. It should be noted that the width 103 and length 102 will change depending upon the size mattress the fitted sheet the blank 100 will be used to construct is designed to fit. Generally speaking, the width 103 will substantially equal in width to the width of a mattress that will be covered by the resulting fitted sheet, plus about two times the depth of the mattress. Meanwhile, length 102 of the blank 100 may be substantially equal to the length of the selected mattress, plus about one to two times the depth of the mattress.

In FIG. 1, fold lines 104,105 are shown. Side margins 106,107 are folded about these fold lines 104,105 in one or more embodiments toward a central panel 108. In one or more embodiments, side margins 106,107 are folded about these fold lines 104,105 in one or more embodiments toward a central panel 108 along their entire length 102. In one or more embodiments, the side margins 106,107 are each folded in half about the fold lines 104,105.

In one or more embodiments, the width 109 of the central panel 108 is greater than the width 110,111 of either side margin 106,107. Illustrating by example, for a "twin mattress" embodiment, the width 109 of the central panel 108 might be about twenty-six inches, while the width 110,111 of the side margins 106,107 is about eleven inches. It should be noted that for mattresses of other sizes, the width 110,111 of the side margins 106,107 and/or the central panel 108 can change. Folding the side margins 106,107 about the fold lines 104,105 results in a folded blank, which is shown in FIG. 2.

Figure 2:
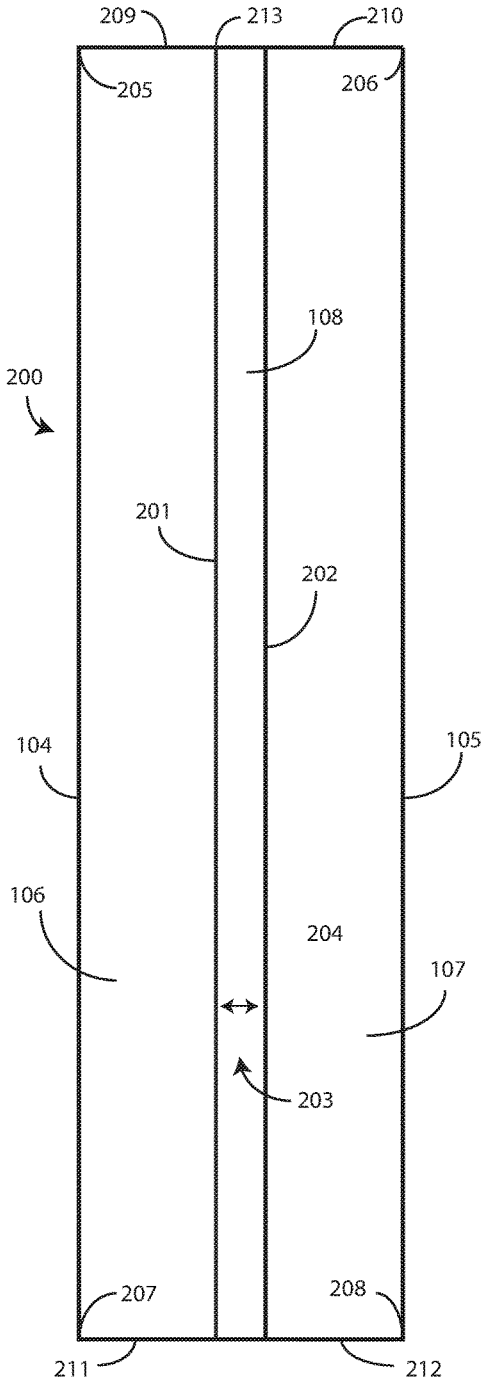
FIG. 2 illustrates a first step in a method of constructing one or more fitted sheets in accordance with one or more embodiments of the disclosure.

As shown in FIG. 2, the side margins 106,107 have been folded about the fold lines 104,105 toward the central panel 108 to form a folded blank 200. In one or more embodiments, the side margins 106,107 are folded about the fold lines 104,105 toward the central panel 108 such that their sides 201,202 lay atop the central panel 108, but do not touch. For example, in this illustrative embodiment, a separation 203 having a width 204 of about four inches exists between the sides 201,202 of the side margins 106,107.

In one or more embodiments, this separation 203 remains constant regardless of mattress size. Thus, a fitted sheet manufactured from the folded blank 200 to fit a twin mattress and a fitted sheet manufactured from the folded blank 200 to fit a queen mattress will still have the separation 203 with a width 204 of about four inches. In other embodiments, this width 204 can increase as mattress width becomes larger.

In the illustrative embodiment of FIG. 2, the folded blank 200 is rectangular in shape, with the folding of the side margins 106,107 are folded about the fold lines 104,105 toward the central panel 108 creating four corners 205,206, 207,208. In one or more embodiments, the folded blank 200 of FIG. 2 can proceed directly to the sewing steps shown in FIG. 4 without additional processing. Where this occurs, seams can stitch the edges 209,210,211,212 where the side margins 106,107 and the central panel 108 abut. For example, a sewing operation can stitch a seam starting at corner 205 along edge 208 to the opposite corner 213 (or in the reverse direction) to couple side margin 106 and the central panel 108 together. Similar operations can be performed along edge 210, edge 211, and edge 212 to create a partial fitted sheet. However, embodiments of the disclosure contemplate that "poofy" corners can result when a rectangular folded blank has its end seams sewn. Advantageously, to eliminate this issue, in one or more embodiments optional steps shown in FIG. 3 are applied.

Figure 3:
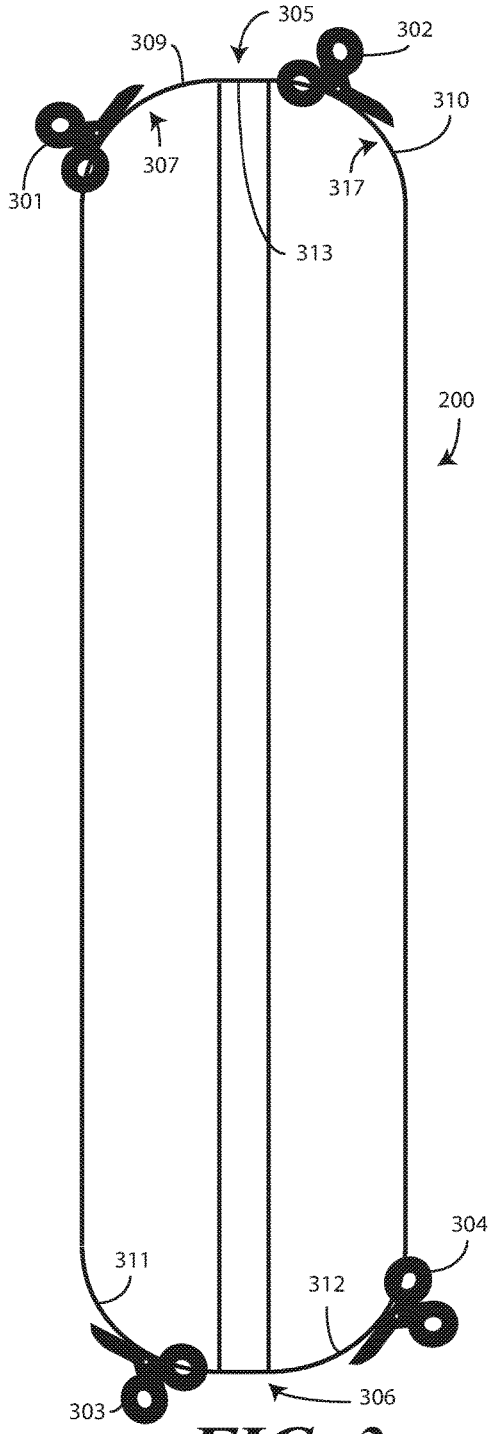
FIG. 3 illustrates a second step in a method of constructing one or more fitted sheets in accordance with one or more embodiments of the disclosure.

Turning now to FIG. 3, in one or more embodiments, one or more cutting operations 301,302,303,304 are applied to corner regions of the folded blank to create arched end edges 309,310,311,312. In this illustrative embodiment, four separate cutting operations 301,302,303,304 are applied to corner regions of the folded blank to create arched end edges 309,310,311,312, with one cutting operation being applied to one corner region. This results in each end 305,306 of the folded blank having two convex ends separated by a straight segment. For example, end 305 has a first convex end 307 and a second convex end 317. The first convex end 307 is separated from the second convex end 317 by straight segment 313. The same is true of end 306.

Figure 4:
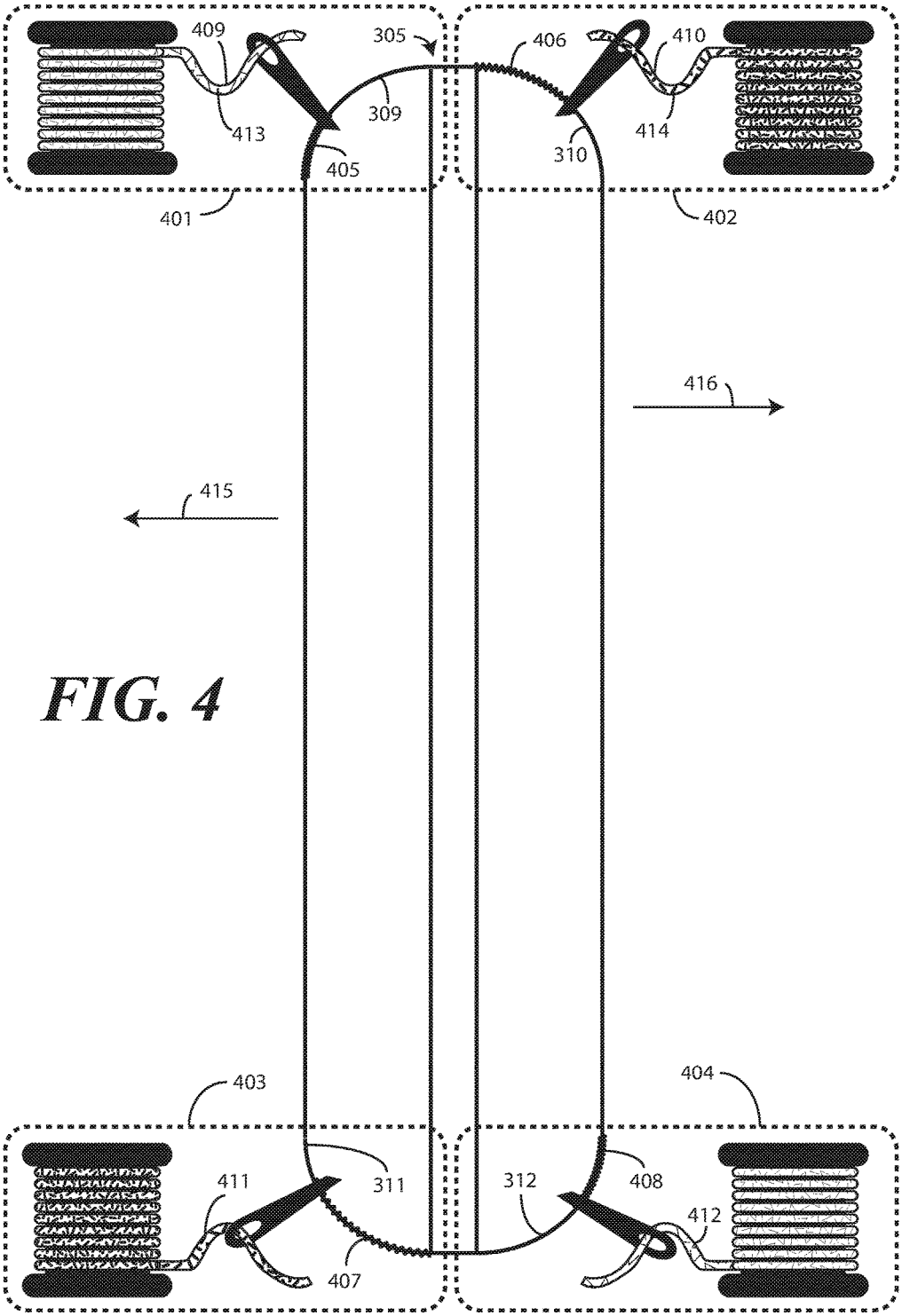
FIG. 4 illustrates a third step in a method of constructing one or more fitted sheets in accordance with one or more embodiments of the disclosure.

Turning now to FIG. 4, in one or more embodiment four separate sewing operations 401,402,403,404 are applied to each arched end edges 309,310,311,312, with each sewing operation being applied to an arched end edge on a one-to-one basis. Illustrating by example, a first sewing operation 401 creates a seam 405 along a first arched end edge 309, while a second sewing operation 402 creates a second seam 406 along a second arched end edge 310. Similarly, a third sewing operation 403 creates a third seam 407 along a third arched end edge 311, while a fourth sewing operation 404 creates a fourth seam 408 along a fourth arched end edge 312.

The separation of the four sewing operations 401,402, 403,404 provides several advantages over prior art sheet constructs. To begin, it allows for enhanced control of the physical characteristics of each seam 405,406,407,408. Specifically, the start and stop points for each seam 405,406, 407,408 can be precisely controlled, as well as the initial stitches and termination ties of each seam 405,406,407,408. The stitch counts and placement for each seam 405,406,407, 408 can also be more precisely controlled. Additionally, embodiments of the disclosure contemplate that the individual and separate stitches 405,406,407,408 can withstand more wear and tear, are less resistant to fraying and being pulled loose, and can withstand more wash/dry cycles than can other constructs where the thread for each seam 405, 406,407,408. Numerous other advantages offered by the application of four separate sewing operations 401,402,403, 404 to each arched end edges 309,310,311,312 on a one-to-one basis will be obvious to those of ordinary skill in the art having the benefit of this disclosure.

In one or more embodiments, to provide an indication that four separate sewing operations 401,402,403,404 are used, each sewing operation 401,402,403,404 uses a different color of thread. For example, in one embodiment the first sewing operation 401 may use a first color of thread 409, e.g., white, while the second sewing operation 402 uses a second color of thread 410, e.g., blue. The third sewing operation 403 may use a third color of thread 411, e.g., green, while the fourth sewing operation 404 uses a fourth color of thread 412, e.g., yellow, and so forth.

In the illustrative embodiment of FIG. 4, since seams 405,406 are disposed at the first end 305 of the folded blank 200, and seams 407,408 are disposed at the second end 306 of the folded blank 200, the fact that four separate sewing operations 401,402,403,404 are applied to each arched end edges 309,310,311,312 can advantageously be indicated by using two colors. Specifically, in this illustrative embodiment the thread 409 used in the first sewing operation 401 and the thread 411 used in the third sewing operation 403 have a common color 413. In one embodiment, that color 413 is white, although others will be obvious to those of ordinary skill in the art having the benefit of this disclosure. Similarly, in one embodiment the thread 410 used in the second sewing operation 402 and the thread 412 used in the fourth sewing operation 404 have a common color 414. In one embodiment, that color 414 is blue, although others will be obvious to those of ordinary skill in the art having the benefit of this disclosure. This results in seams 405,407, both disposed on a common side 415 of the folded blank 200, having a common color 413, while seams 406,408 both disposed on another common side 416 of the folded blank 200, having another common color 414, which is different from common color 413. This instantly connotes to a user that four separate sewing operations 401,402,403,404 are applied to each arched end edges 309,310,311,312.

In another embodiment, two colors 413,414 are again used. However, in this other embodiment, the colors 413,414 alternate as one moves clockwise about the folded blank 200. Illustrating by example, in one embodiment the thread 409 used in the first sewing operation 401 and the thread 412 used in the fourth sewing operation 403 have a common color, while the thread 410 used in the second sewing operation 402 and the thread 411 used in the third sewing operation 403 have a different common color. This results in seams 405,407, both disposed on a common side 415 of the folded blank 200, having different colors, while seams 406,408 both disposed on another common side 416 of the folded blank 200, also have different colors. This instantly connotes to a user that four separate sewing operations 401,402,403,404 are applied to each arched end edges 309,310,311,312.

Note that while the application of cutting operations (301,302,303,304) are shown in FIG. 3 as being made prior to the sewing operations 401,402,403,404 of FIG. 4 in one embodiment, in other embodiments these cutting operations (301,302,303,304) and sewing operations 401,402,403,404 could be reversed, with the cutting operations (301,302,303, 304) being performed after the sewing operations 401,402, 403,404. For example, the sewing operations 401,402,403, 404 could be applied to the folded blank of FIG. 2, to create the seams 405,406,407,408, with cutting operations (301, 302,303,304) being performed thereafter.

In another embodiment, the cutting operations (301,302, 303,304) and sewing operations 401,402,403,404 can be performed simultaneously. For example, the sewing operations 401,402,403,404 can create the seams 405,406,407, 408 along the folded blank of FIG. 2, and as each seam 405,406,407,408 is sewn, a blade present in the sewing device can cut the arched end edges 309,310,311,312 about the seams 405,406,407,408. Other construction techniques to apply the various seams 405,406,407,408 will be obvious to those of ordinary art having the benefit of this disclosure.

Figure 5:
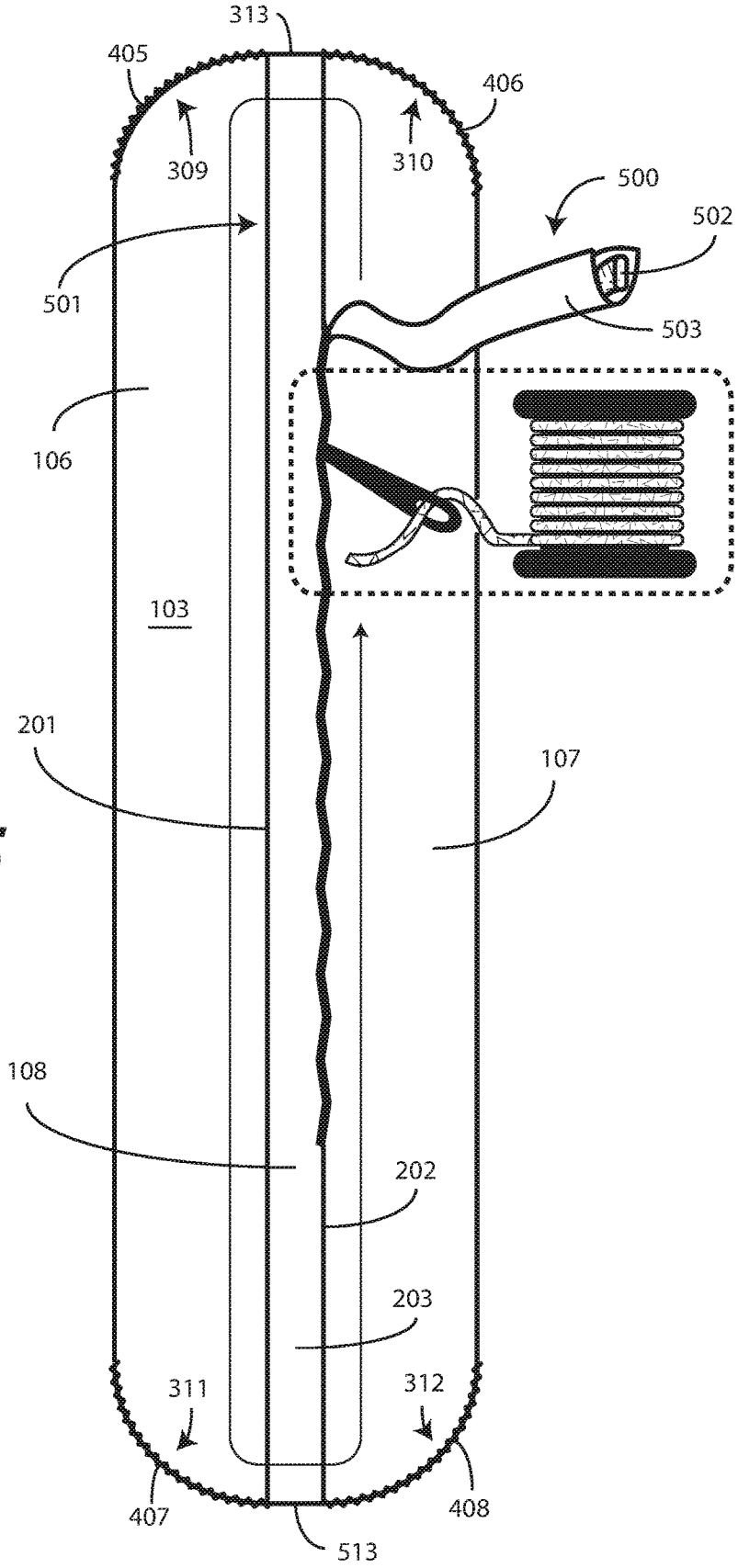
FIG. 5 illustrates a fourth step in a method of constructing one or more fitted sheets in accordance with one or more embodiments of the disclosure.

Turning now to FIG. 5, once the four separate sewing operations (401,402,403,404) are applied to each arched end edges 309,310,311,312 to create the four seams 405,406, 407,408, a gathering 500 can be applied about a perimeter 501 of the separation 203 between the sides 201,202 of the side margins 106,107. This perimeter 501 consists of the sides 201,202 of the side margins 106,107 and straight segment 313 of the central panel 108 and straight segment 513 of the central panel 108.

In a first embodiment, the gathering 500 comprises elastic 502 placed within a border wrapper 503. In one or more embodiments, the border wrapper 503 is a thin strip of textile material that wraps about the elastic 502, as well as the edges of the folded blank 200 defining the perimeter 501. In one or more embodiments, the border wrapper 503 is a different color than the textile material 113. For example, if the textile material 113 is white, the border wrapper 503 may be blue, and so forth. Other color combinations will be obvious to those of ordinary skill in the art having the benefit of this disclosure.

Figure 6:
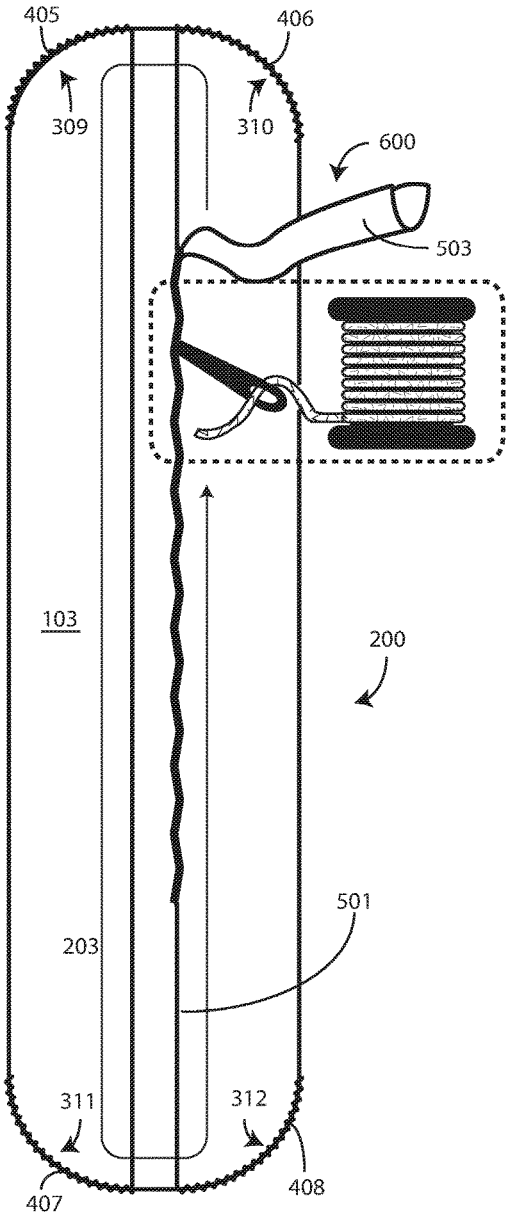
FIG. 6 illustrates an optional fourth step in a method of constructing one or more fitted sheets in accordance with one or more embodiments of the disclosure.

Turning to FIG. 6, illustrated therein is an alternate method step to that shown in FIG. 5. As with FIG. 5, once the four separate sewing operations (401,402,403,404) are applied to each arched end edges 309,310,311,312 to create the four seams 405,406,407,408, another gathering 600 can be applied about a perimeter 501 of the separation 203. In this embodiment, the gathering 600 comprises only the border wrapper 503, and does not include elastic (502). As before, in one or more embodiments, the border wrapper 503 is a thin strip of textile material that wraps about the edges of the folded blank 200 defining the perimeter 501. In one or more embodiments, the border wrapper 503 is a different color than the textile material 113. For example, if the textile material 113 is white, the border wrapper 503 may be green, and so forth. Other color combinations will be obvious to those of ordinary skill in the art having the benefit of this disclosure.

Figure 7:
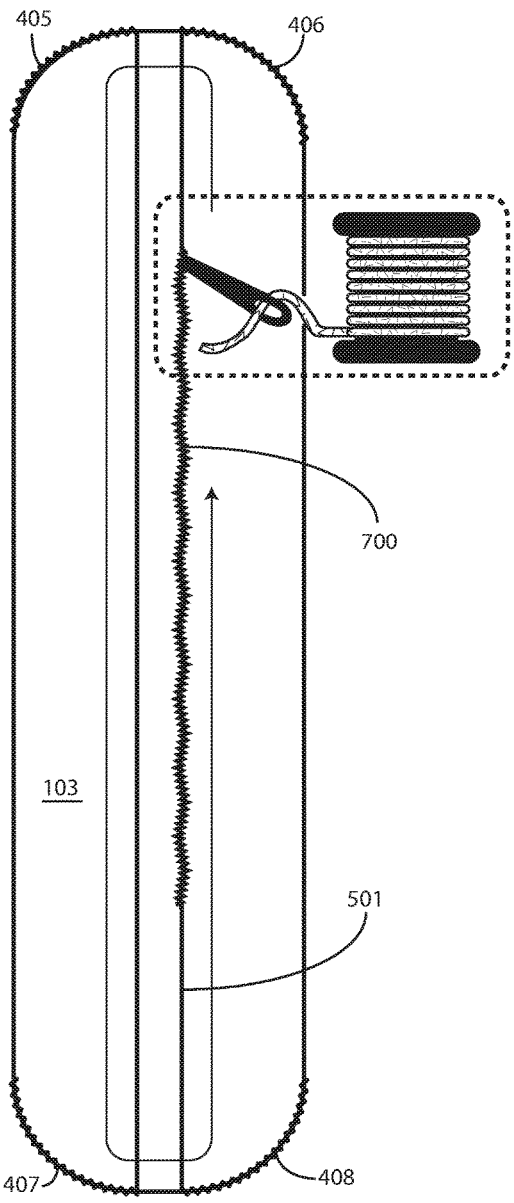
FIG. 7 illustrates another optional fourth step in a method of constructing one or more fitted sheets in accordance with one or more embodiments of the disclosure.

Turning now to FIG. 7, illustrated therein is yet another alternate method step for the method steps shown in FIGS. 5 and 6. In this illustrative embodiment. once the four separate sewing operations (401,402,403,404) are applied to each arched end edges 309,310,311,312 to create the four seams 405,406,407,408, the edges of the perimeter 501 are finished only with a finishing seam 700. Neither a border wrapper nor elastic are included. Embodiments of the disclosure contemplate that, in some unfortunate circumstances, one or both of the border wrapper and/or the elastic can be removed and used for purposes other than those for which they were intended. Accordingly, to ensure that this does not happen, in one or more embodiments the edges of the perimeter 501 are finished only with a simple finishing seam 700 to prevent fraying. It should be noted that the finishing seam 700 can be a different color than the textile material 113. For example, if the textile material 113 is beige, the finishing seam 700 may be white, and so forth. Other color combinations will be obvious to those of ordinary skill in the art having the benefit of this disclosure.

Figure 8:
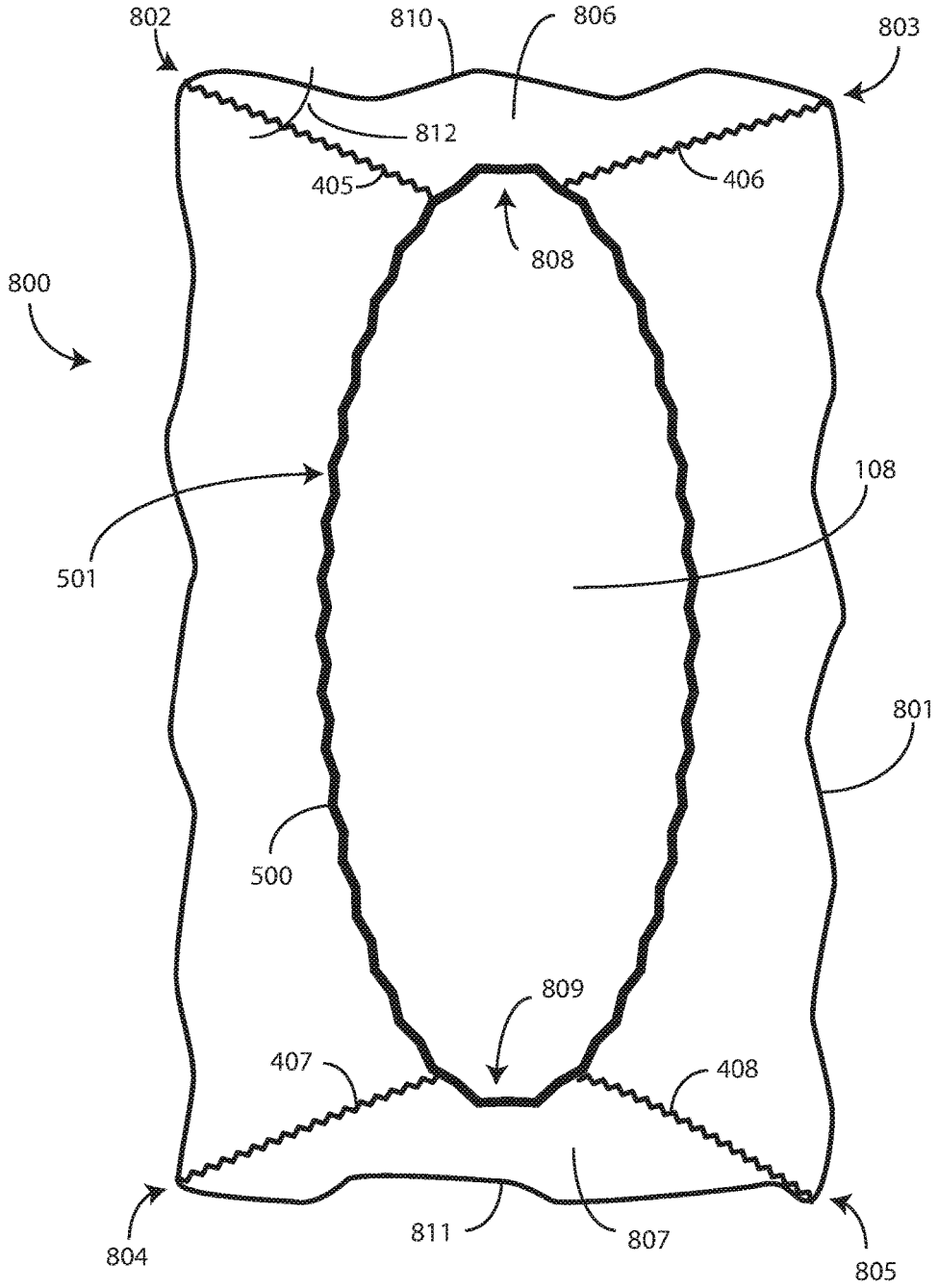
FIG. 8 illustrates an explanatory fitted sheet in accordance with one or more embodiments of the disclosure.

Turning now to FIG. 8, illustrated therein is a fitted sheet 800 that has been manufactured using the steps shown in FIGS. 2, 3, 4, and 5. In this embodiment, the fitted sheet 800 has been laid flat on its upper surface, with the lower surface exposed in plan view as shown in FIG. 8. The fitted sheet 800 thus defines a substantially rectangular perimeter 801 with four corners 802,803,804,805.

Once the gathering 500 is applied, the elastic (502) therein causes the perimeter 501 to contract, thereby defining an ovular shape. In particular, a first portion 806 and a second portion 807 of the central panel 108 are pulled inward toward the perimeter 501 due to the action of the elastic (502). This pulling action causes each of the first portion 806 and the second portion 807 of the central panel 108 to take on substantially a frustoconical shape. As used herein, the term "frustoconical" takes its ordinary, plain, English definition of "having the shape of a frustum of a cone." A "frustum" of a cone, of course, is the portion of a cone or pyramid that lies between two parallel planes cutting it. Thus, each of the first portion 806 and the second portion 807 includes substantially a frustoconical shape, even though the top edges 808,809 of each frustum are slightly rounded due to the gathering action of the elastic (502).

In one or more embodiments, when the fitted sheet 800 is been laid flat on its upper surface, with the lower surface exposed in plan view, thereby defining a substantially rectangular perimeter 801 with four corners 802,803,804,805, the gathering action of the elastic (502) disposed in the gathering 500 causes each seam 405,406,407,408 to extend distally from the perimeter 801, relative to end edges 810, 811, at an acute angle 812. In one embodiment, this acute angle 812 is between twenty and forty degrees. Illustrating by example, seam 405 extends from corner 802, relative to end edge 810, at an angle of about thirty degrees in this embodiment. Seam 406 extends from corner 803, relative to end edge 810, at about the same angle in this embodiment, and so forth.

Figure 9:
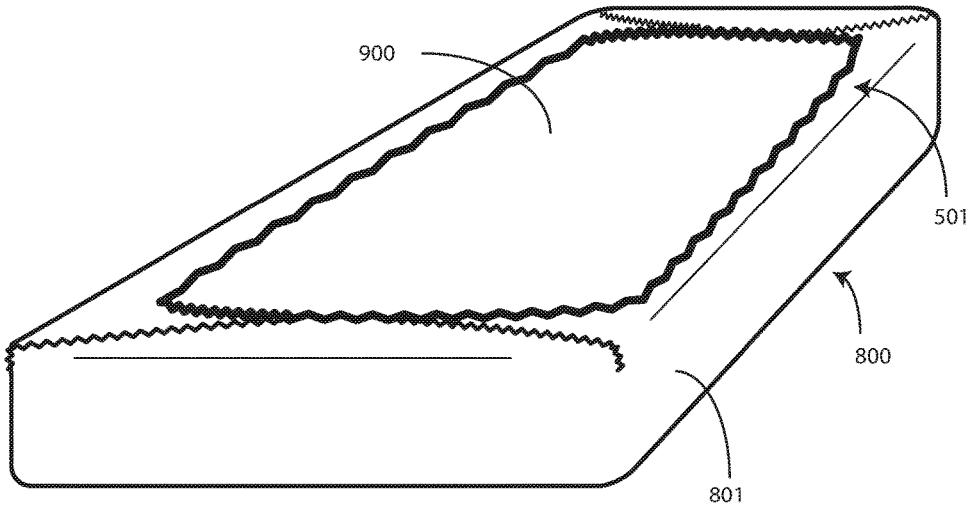
FIG. 9 illustrates a bottom perspective view of one explanatory fitted sheet in accordance with one or more embodiments of the disclosure applied to a mattress.

Turning now to FIG. 9, illustrated therein is the fitted sheet 800 fitted to a mattress 900. The perimeter 501 of the fitted sheet 800 has been pulled about the edges 901 of the mattress 900 for a snug fit. The contraction of the elastic (502) causes the perimeter 501 to decrease in circumference, thereby causing the fitted sheet 800 to cling to the mattress 900.

Figure 10:
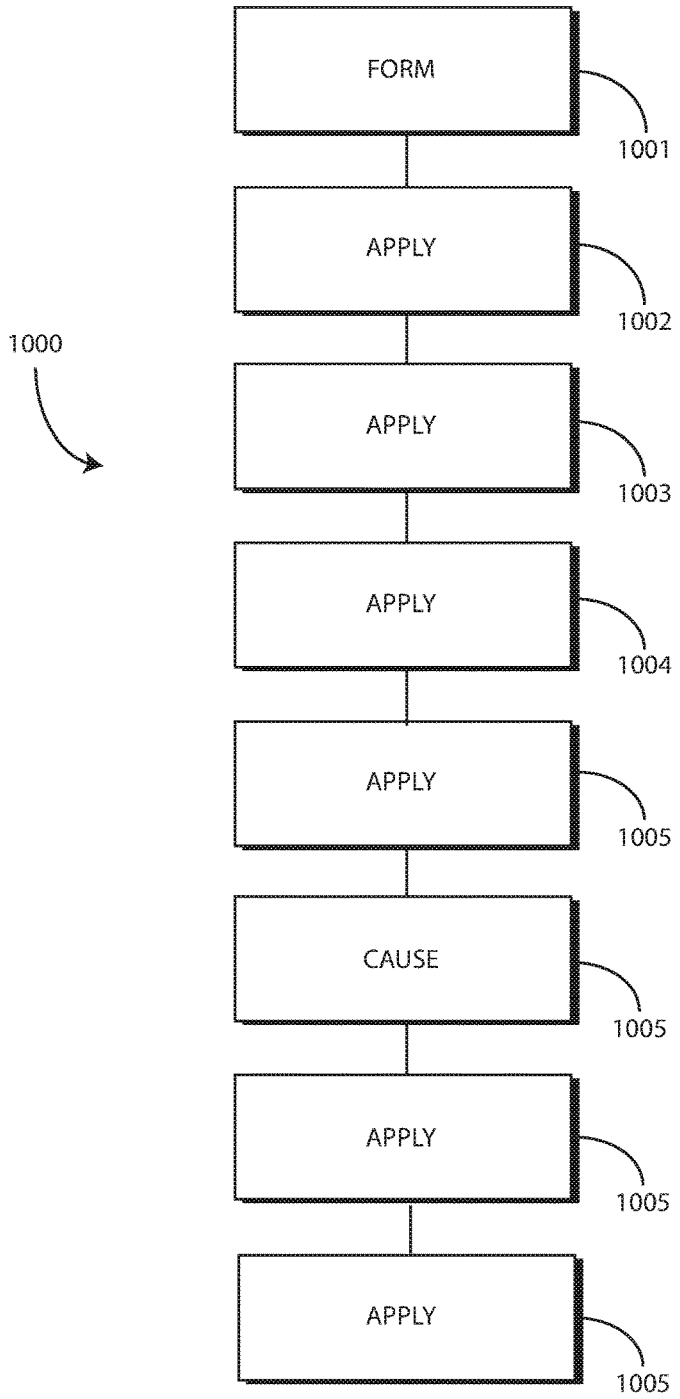
FIG. 10 illustrates one explanatory method in accordance with one or more embodiments of the disclosure.

Turning now to FIG. 10, illustrated therein is one explanatory method 1000 for manufacturing a fitted sheet in accordance with one or more embodiments of the disclosure. Beginning at step 1001, the method 1000 includes forming a folded blank by folding a first side margin of a blank about a first fold line atop a central panel of the blank and folding a second side margin of the blank about a second fold line atop the central panel, wherein sides of the first side margin and the second side margin are separated by a separation.

At step 1002, the method 1000 includes applying, with a first sewing operation, a first seam to a first edge where a first end of the first side margin and the central panel abut. At step 1003, the method 1000 includes applying, with a second sewing operation different from the first sewing operation, a second seam, separate from the first seam, to a second edge of the first side margin where a second end of the first side margin and the central panel abut.

At step 1004, the method 1000 includes applying, with a third sewing operation different from either the first sewing operation or the second sewing operation, a third seam along a third edge where a first end of the second side margin and the central panel abut. At step 1005, the method 1000 includes applying, with a fourth sewing operation different from any of the first sewing operation, the second sewing operation, or the third sewing operation, a fourth seam along a fourth edge where a second end of the second side margin and the central panel abut.

At step 1006, the method 1000 includes causing at least one seam of the first seam, the second seam, the third seam, or the fourth seam to have a color that is different from another seam of the first seam, the second seam, the third seam, or the fourth seam. At step 1007, the method 1000 includes applying a cutting operation causing the first edge, the second edge, the third edge, and the fourth edge to each define arched end edges. It should be noted that step 1007 could be performed before, or after, steps 1002-1005. At step 1008, the method 1000 includes applying one or more of a finishing stitch or a border wrapper to a perimeter defined by a first end of the first side margin, a second end of the second side margin, a first straight segment of the central panel, and a second straight segment of the central panel.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A fitted sheet, comprising:

a blank defining a central panel, a first side margin, and a second side margin, wherein the first side margin and the second side margin are folded about a first fold line and a second fold line, respectively, toward the central panel along their lengths such that sides of the first side margin and the second side margin are separated by a separation, thereby defining a folded blank having a first edge and a second edge where the first side margin and the central panel abut, and a third edge and a fourth edge where the second side margin and the central panel abut;

wherein:

the first edge comprises a first seam applied by a first sewing operation;

the second edge comprises a second seam, separate from the first seam, and applied by a second sewing operation separate from the first sewing operation;

the third edge comprises a third seam, separate from either the first seam or the second seam, and applied by a third sewing operation separate from either the first sewing operation or the second sewing operation; and the fourth edge comprises a fourth seam, separate from any of the first seam, the second seam, or the third seam, and applied by a fourth sewing operation separate from any of the first sewing operation, the second sewing operation, or the third sewing operation;

wherein one of the first seam, the second seam, the third seam, or the fourth seam, is a different color than another of the first seam, the second seam, the third seam, or the fourth seam.

2. The fitted sheet of claim 1, wherein:

the first seam and the second seam are disposed at a first end of the folded blank;

the third seam and the fourth seam are disposed at a second end of the folded blank; and the first end of the folded blank and the second end of the folded blank are separated by a major axis of the folded blank.

3. The fitted sheet of claim 2, wherein the first edge, the second edge, the third edge, and the fourth edge each defined arched end edges.

4. The fitted sheet of claim 3, wherein a first of the first seam, the second seam, the third seam, or the fourth seam has a common color with a second of the first seam, the second seam, the third seam, or the fourth seam.

5. The fitted sheet of claim 4, wherein the first seam and the third seam have the common color.

6. The fitted sheet of claim 5, wherein the second seam and the fourth seam have the different color.

7. The fitted sheet of claim 4, wherein the first seam and the fourth seam have the common color.

8. The fitted sheet of claim 5, wherein the second seam and the fourth seam have the different color.

9. The fitted sheet of claim 1, wherein the first seam, the second seam, the third seam, and the fourth seam each have different colors.

10. The fitted sheet of claim 1, further comprising a finishing seam disposed along a perimeter defined by a first end of the first side margin, a second end of the second side margin, a first straight segment of the central panel, and a second straight segment of the central panel.

11. The fitted sheet of claim 1, further comprising a border wrapper disposed along a perimeter defined by a first end of the first side margin, a second end of the second side margin, a first straight segment of the central panel, and a second straight segment of the central panel.

12. The fitted sheet of claim 11, further comprising elastic disposed within the border wrapper.

13. The fitted sheet of claim 12, the fitted sheet, in bottom plan view, defining a substantially rectangular perimeter, wherein a first portion of the central panel disposed between the perimeter and the substantially rectangular perimeter defines a frustoconical shape.

14. The fitted sheet of claim 13, wherein a second portion of the central panel disposed between the perimeter and the substantially rectangular perimeter defines a second frustoconical shape.

15. The fitted sheet of claim 13, each of the first seam, the second seam, the third seam, and the fourth seam extending distally from the substantially rectangular perimeter at an acute angle relative to an end edge of the substantially rectangular perimeter.

16. The fitted sheet of claim 13, the angle between twenty and forty degrees, inclusive.

17. A method of making a fitted sheet, comprising:

forming a folded blank by folding a first side margin of a blank about a first fold line atop a central panel of the blank and folding a second side margin of the blank about a second fold line atop the central panel, wherein sides of the first side margin and the second side margin are separated by a separation and the folded blank defines:

a first edge where a first end of the first side margin and the central panel abut; and a second edge of the first side margin where a second end of the first side margin and the central panel abut;

applying a cutting operation causing the first edge and the second edge to each define arched end edges;

applying, with a first sewing operation, a first seam to the first edge; and applying, with a second sewing operation different from the first sewing operation, a second seam, separate from the first seam, to the second edge.

18. The method of claim 17, further comprising:

applying, with a third sewing operation different from either the first sewing operation or the second sewing operation, a third seam along a third edge where a first end of the second side margin and the central panel abut; and applying, with a fourth sewing operation different from any of the first sewing operation, the second sewing operation, or the third sewing operation, a fourth seam along a fourth edge where a second end of the second side margin and the central panel abut;

wherein at least one seam of the first seam, the second seam, the third seam, or the fourth seam has a color that is different from another seam of the first seam, the second seam, the third seam, or the fourth seam.

19. The method of claim 17, wherein one of the first seam or the second seam is a different color than another of the first seam or the second seam.

20. The method of claim 17, further comprising applying one or more of a finishing stitch or a border wrapper to a perimeter defined by a first end of the first side margin, a second end of the second side margin, a first straight segment of the central panel, and a second straight segment of the central panel.

* * * * *